United States Patent [19]

Schuster et al.

[11] Patent Number: 4,527,993

[45] Date of Patent: Jul. 9, 1985

[54] PROCESS FOR PRODUCING TRANSFER PRINTING PAPERS WITH FOAMED AQUEOUS INK

[75] Inventors: Claus Schuster, Hofheim am Taunus; Horst Homuth, Frankfurt am Main, both of Fed. Rep. of Germany

[73] Assignee: Hoechst Aktiengesellschaft, Fed. Rep. of Germany

[21] Appl. No.: 592,222

[22] Filed: Mar. 22, 1984

[30] Foreign Application Priority Data

Mar. 24, 1983 [DE] Fed. Rep. of Germany ..... 3310689

[51] Int. Cl.[3] ..... B41M 5/26; D06P 5/13

[52] U.S. Cl. ..... 8/471; 8/477; 8/919; 106/22; 427/148

[58] Field of Search ..... 8/471, 477; 427/148

[56] References Cited

U.S. PATENT DOCUMENTS

| | | | |
|---|---|---|---|
| 4,275,656 | 6/1981 | Choma | 8/477 |
| 4,289,496 | 9/1981 | Lister | 8/477 |
| 4,326,904 | 4/1982 | Eckert et al. | 8/477 |
| 4,384,867 | 5/1983 | Gruber | 8/477 |
| 4,387,132 | 6/1983 | Hain | 8/471 |

*Primary Examiner*—A. Lionel Clingman

*Attorney, Agent, or Firm*—Connolly and Hutz

[57] ABSTRACT

In printing transfer papers with standard aqueous print pastes, the local swelling of the paper substance gives rise to the problem of the dimensional stability of the papers. These disadvantages are eliminated according to the invention by using as print pastes foamed dyestuff liquors in which the consistency of the foam acts as thickening agents. As a result the moisture content in the print pastes can be reduced.

5 Claims, No Drawings

PROCESS FOR PRODUCING TRANSFER PRINTING PAPERS WITH FOAMED AQUEOUS INK

The present invention relates to a process for producing transfer papers for thermoprinting with sublimable dyestuffs, in particular transferable disperse dyestuffs, on printing machines customary in textile printing.

It is generally known how to produce transfer printing papers of the type defined above. As a rule, it is done by patterning papers which are to serve as transfer carriers with aqueous print pastes containing thickeners and suitable dyestuffs. However, these processes hitherto customary for said purpose give rise to the problem that the printed papers start to swell in places as a result of the paper substance absorbing moisture from the high water content of the print pastes used for this purpose, and become cockled. This makes it difficult to dry the ink carrier so that it becomes smooth again and dimensionally stable, which properties have a great influence on the true to the original reproduction of the design to be transferred. Moreover, the energy consumed in drying these products is high, corresponding approximately to the amount of water applied with the print paste.

Attempts have therefore already been made to counteract this impairment; however, in doing so, other deficiencies had to be accepted in turn. For example, using print pastes which contain solvent, which are partially aqueous or which are pure-solvent liquid media brings with it the disadvantage of environmental pollution and odor nuisance and makes the print pastes, and hence the finished transfer paper, more expensive.

Accordingly, it is the object of the invention described below to accomplish the production of satisfactory, dimensionally stable transfer papers with the use of aqueous-based print pastes which avoid the above-mentioned negative phenomena.

This object is achieved then according to the invention by processing one or more dyestuff-containing aqueous liquors made finely porous by means of surfactants into stable foams, printing the transfer carrier in the desired pattern with each of the foams thus generated, and then drying this transfer carrier.

The new process advantageously utilizes the principle of using foamed dyeing liquors as print pastes in which the consistency of the foam acts as a thickener. As a result of the high degree to which the liquors are foamed, viz. within the range from 1:10 to 1:150, preferably from 1:40 to 1:80, so little water gets onto the paper that any local swelling thereof is no longer important and the loss of dimensional stability associated with swelling is largely eliminated.

The drying costs for the finished ink carrier can accordingly also be reduced to the extent that the water content in the print pastes is reduced, and the possibility of environmental pollution is excluded owing to the absence of solvents.

The surfactants used in the process to enable the liquors to be foamed can be anionic or non-ionic products having high foaming power. Examples which may be mentioned are alkylarylsulfonates, alkyldimethylamine oxides, hydroxyalkanesulfonates, alkanesulfonates and mixtures of such compounds.

The liquors to be foamed can of course, if necessary, also have added to them amounts, reduced compared with the standard print pastes, of thickeners or binders which are customary for this purpose and which ensure good adhesion of the dyestuffs to the paper.

Owing to the effectiveness of the foam, the new process makes it possible to apply dyestuff to the transfer carrier in the form of, in the main, a surface print, as a consequence of which the concentration of dyestuff in the foamed batch can be reduced. The consequently reducible amount of film-forming agent necessary (for preventing abrasion) and the fact that a thickener can be largely dispensed with in the first place then, in the course of the sublimation process during thermoprinting, lead to easier transfer of dyestuff and yield advantages.

EXAMPLE

Three aqueous liquors which contain per liter, respectively, 80 g of the dyestuff Disperse Yellow 54 with the C.I. No. 47,020, 10 g of the dyestuff Disperse Red 60 with the C.I. No. 60,756, and 10 g of the dyestuff Disperse Blue 56 with the C.I. No. 63,285 have each added to them, per liter, 20 g of an alkylarylsulfonate and are foamed in a ratio of 1:50 by blowing air into them as blowing agent. They are turned into stable finely porous foams.

The foams thus produced from the various inks are then printed in succession onto a sheet of transfer paper in a rotary printing machine, and the paper is subsequently dried.

This gives a satifactory print. The printed paper has excellent dimensional stability.

We claim:

1. A process for producing transfer papers for thermoprinting with sublimable dyestuffs on printing machines customary in textile printing, which comprises foaming one or more aqueous liquors containing sublimable dyestuff and anionic or non-ionic surfactants having high foaming power into finely porous and stable foams, printing the transfer carrier in the desired pattern with each of the foams thus generated, and then drying this transfer carrier.

2. The process as claimed in claim 1, wherein the foamed liquors additionally contain small amounts of thickeners or binders.

3. The process as claimed in claim 1, wherein the liquors are foamed to a volume 10 to 150 times the volume of the original liquor volume.

4. A transfer paper for thermoprinting with sublimable dyestuffs, obtained by a process as claimed in claim 1.

5. The process as claimed in claim 1 wherein the liquors are foamed to a volume 40 to 80 times the volume of the original liquor volume.

* * * * *